United States Patent [19]

McKee, Sr. et al.

[11] Patent Number: 4,842,143

[45] Date of Patent: Jun. 27, 1989

[54] DEVILED EGG CONTAINER

[76] Inventors: John W. McKee, Sr., 1918 - 4th St.; John W. McKee, Jr., 503 Blunt St., both of Clay Center, Kans. 67432

[21] Appl. No.: 171,890

[22] Filed: Mar. 22, 1988

[51] Int. Cl.[4] ..... B65D 43/16

[52] U.S. Cl. ..... 206/521.1; 206/463; 206/521.2; 426/106; 426/119

[58] Field of Search ..... 220/315, 21, 23.8, 339; 229/2.5 EC; 206/449, 463, 521.1, 521.2; 426/106, 113, 119, 614; 249/121; 99/440; 217/26.5; 211/14

[56] References Cited

U.S. PATENT DOCUMENTS

| | | | |
|---|---|---|---|
| 545,567 | 9/1895 | Baker | 217/26.5 |
| 1,507,133 | 9/1924 | Loeble | 217/26.5 |
| 1,967,040 | 7/1934 | Pickett | 217/26.5 |
| 3,164,478 | 1/1965 | Bostrom | 426/119 |
| 3,311,231 | 3/1967 | English, Jr. | 217/26.5 |
| 3,541,892 | 3/1970 | Glasser et al. | 426/614 |
| 3,556,337 | 1/1971 | Harmon et al. | 206/449 |
| 3,851,571 | 12/1974 | Nichols | 426/113 |

FOREIGN PATENT DOCUMENTS

| | | | |
|---|---|---|---|
| 543633 | 12/1955 | Belgium | 211/14 |
| 2103160 | 8/1972 | Fed. Rep. of Germany | 99/440 |
| 1341973 | 11/1963 | France | 217/26.5 |
| 234388 | 5/1925 | United Kingdom | 99/440 |

*Primary Examiner*—Stephen Marcus

*Attorney, Agent, or Firm*—Litman, McMahon & Brown

[57] ABSTRACT

A container for deviled eggs and the like includes a double, transparent plate assembly molded to generally conform to the contours of a deviled egg. Each plate assembly is designed to hold one or more deviled eggs. Into the upper plate of each assembly are molded elliptical hemispheres for storing the yolk mixture of each deviled egg. Into the lower plate of the assembly are molded elliptical hemispheres which are larger than those of the upper plate and which house the white of each deviled egg. The outer peripheral surface surrounding each elliptical hemisphere in the upper plate acts as a shoulder which abuts against and holds the white portion of each deviled egg snuggly in its molded elliptical hemisphere.

6 Claims, 1 Drawing Sheet

DEVILED EGG CONTAINER

BACKGROUND OF THE INVENTION

1. Field of the Invention

The present invention relates generally to container assemblies and, in particular, to container assemblies for housing and transporting deviled eggs.

2. Description of the Prior Art

Deviled eggs are very popular delicatessen food items, but the deviled eggs are easily damaged and mutilated by the jarring forces encountered in transportation. In addition, the yolk mixture, nested in the white of the egg, is easily jarred loose and deformed, destroying the aesthetic appeal.

Although containers have previously been designed to accommodate hard boiled eggs, such containers have cavities which are the shape of a whole egg. Since the filling in the middle of a deviled egg is smaller than the half of the egg white that holds the filling, the filling is not supported and may become dislodged from the white.

Consequently, there is a need in the industry for a container that will supportingly hold both the one-half hard boiled egg white and smaller deviled egg filling during transportation and handling to prevent damage to the product, especially the filling.

SUMMARY OF THE INVENTION

In the practice of the present invention, a deviled egg container is provided which is adapted to conform to the shape of a deviled egg. Each container preferably houses two (or a multiple of two) deviled eggs. The deviled egg container is comprised of two plates, an upper and a lower plate. The upper plate is molded to generally conform to the shape of an upper yolk mixture portion of each deviled egg. The lower plate is molded to generally conform to the shape of the white lower portion of each deviled egg. The shape of the egg molding in each plate is generally an elliptical hemisphere. The upper and lower plates are centered and maintained in relative alignment with one another during use. A shoulder is formed between the facing edges of the upper and lower hemispheres when mated, which shoulder functions to hold the white portion of a deviled egg in a fixed position during transport or handling of the container with an egg therein. In one embodiment, the plates are hinged at one end and held in an aligned closed position by a fastener. In the alternative, the relative alignment between the plates may be maintained by nesting a smaller rectangular recessed portion on one of the plates with larger rectangular recessed portion contained on the opposite plate and held by a fastener.

PRINCIPAL OBJECTS OF THE PRESENT INVENTION

The principal objects of the present invention are: to provide a container for housing deviled eggs and the like; to provide such a container which is adapted to maintain the deviled egg in its original shape; to provide a container which, because of its rigidity, protects the delicate structure of the deviled egg; to provide a container which is transparent to allow its aesthetic qualities to attract potential buyers; and to provide such a container which is economical to manufacture, efficient in operation, and capable of maintaining the deviled eggs' shape through relatively torturous handling and distribution.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
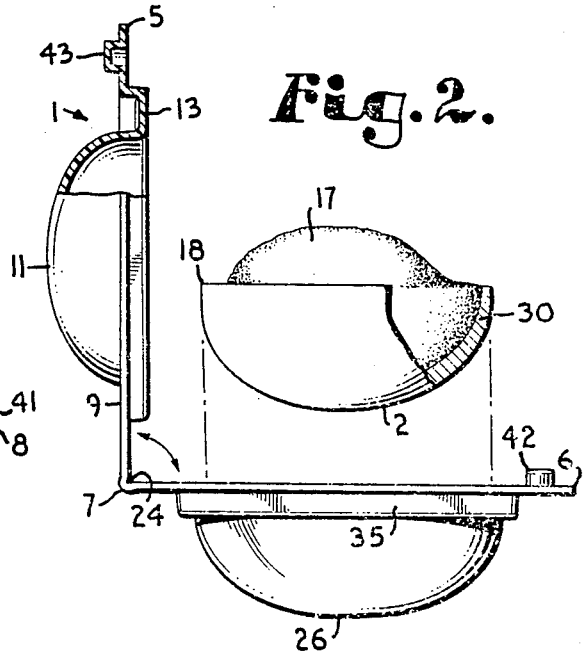
FIG. 2 is a side elevational view of the deviled egg container showing the container in an open configuration for inserting or removing the deviled egg, with portions broken away to show detail thereof.
Figure 3:
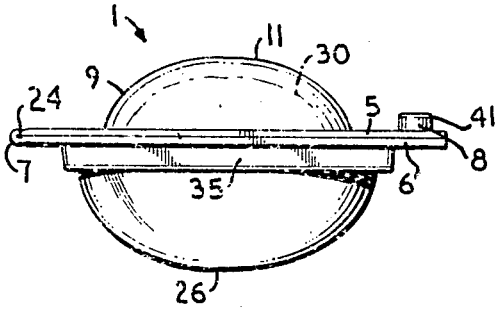
FIG. 3 is a side elevational view of the deviled egg container in the closed configuration.

As used herein, the relative orientations of the present invention and the parts thereof are as follows: the term "front" is to the right in FIG. 2 and the term "rear" is in the opposite direction, the terms "up" and "down" have the same meaning as shown in FIGS. 2 and 3.

The reference numeral 1 generally designates a container 1 for deviled eggs 2 embodying the present invention. The deviled egg container 1 comprises an upper panel or plate 5, a lower panel or plate 6, a hinge 7 and fastening means such as a fastener 8. The illustrated container assembly 1 is designed to house two deviled eggs 2; however, it is foreseen that a container could be prepared to hold one or many (for example, twelve) deviled eggs 2. Both the upper plate 5 and the lower plate 6 are preferably constructed or formed from a single sheet of transparent synthetic material 9.

Figure 1:
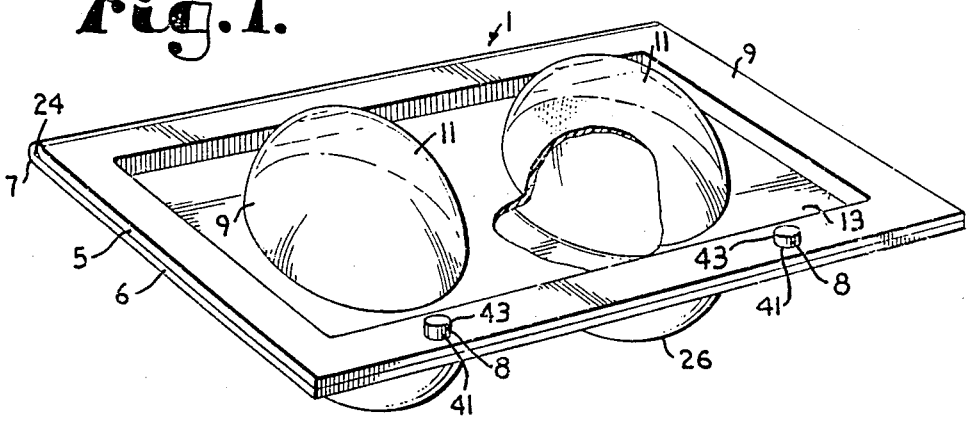
FIG. 1 is a perspective view of a deviled egg container, according to the present invention showing the plates of the container held in a closed and abutting configuration by fasteners.

The upper plate 5 includes two upper formal portions or elliptical hemispheres 11 molded into the sheet 9 of transparent synthetic material. The upper elliptical hemispheres 11 are laterally spaced across the upper plate 5. The shape of the elliptical hemisphere 11 are such to accommodate the shape of a yolk mixture 17 of a deviled egg 2 and, in particular, have a shape and outer edge cross-section that are similar to but substantially smaller than an egg and which is adapted to receive the deviled yolk mixture that extends above the hardened white portion of a deviled egg 2. The major axis of each upper elliptical hemisphere 11 is oriented at right angles to the front and rear edge of the deviled egg container 1. In the preferred embodiment, each upper elliptical hemisphere 11 in the upper plate 5 is oriented in an upper alignment recess 13 which serves the purpose of aligning the lower plate 6 when both plates are engaged in the position shown in FIG. 1. In particular, the recess 13 is a portion of the sheet 9 holding the hemisphere 11 and offset from the place of the remainder of the sheet 9. It is noted that the shape of each upper hemisphere 11 approximately the shape of one-half of an egg yolk bisected along the major axis thereof.

In the illustrated embodiment, the lower plate 6 is connected by a hinge 7 to the upper plate 2. The hinge 7 is comprised of a crease 24 molded in a continuous sheet of transparent synthetic material also comprising the upper sheet 9. The hinge 7 is located at a position corresponding to the rear edges of the upper plate 5 and the lower plate 6. The crease 24 allows for flush abutment of the parallel surfaces of the upper plate 5 and the lower plate 6.

Figure 4:
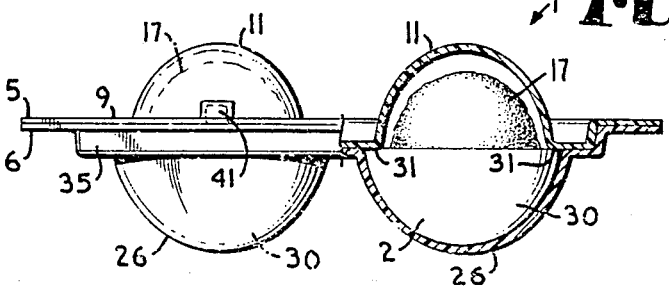
FIG. 4 is a front elevational view of the deviled egg container with portions broken away to show detail thereof.

The lower plate 6 has positioned thereon a pair of lower formed positions or elliptical hemispheres 26. The major and minor axes of the lower hemisphere 26 align with the corresponding axes of the upper elliptical hemispheres 11. The shape and size of the lower elliptical hemispheres 26 is designed to conform to the shape of a lower white half 30 of the deviled egg 2 and is larger than the upper hemisphere 11 so as to form a shoulder 31 therebetween when pairs of hemispheres 11 and 26 are mated together in facing relationship such as is shown in FIG. 4. The lower elliptical hemispheres 26 are positioned in a lower alignment recess 35 that is oriented to extend outwardly from the plate 6 in the opposite direction of the recess 13 from the plate 5. The lower recess 35 is shaped and oriented to snugly receive the upper alignment recess 13 of the upper plate 5 when the plates 5 and 6 are abutted one against the other, thereby preventing movement of the plates 5 and relative to one another about the hinge 7 as long as the plates 5 and 6 are not otherwise fastened together by fastening means. The shape of each lower hemisphere 26 approximates one-half of an egg white bisected along the major axis thereof.

Once the upper plate 5 and the lower plate 6 are abutted together, they are held and locked into position by fastening means such as tape, staples, glue or the like. In the illustrated embodiment, the fastening means 8 include a pair of moulded male and female button fasteners. Each fastener includes a male portion 42 that interferingly mates with a female portion 43 when pushed together by a user and which secure the plates 5 and 6 together until the female and male portions 42 and 43 are pulled apart by a user. The fasteners 41 are positioned at the front edges of the upper plate 5 and the lower plate 6. It is foreseen that the fastening means may be other suitable fasteners such as clamps, staples, glue or the like.

It is also foreseen that the hinge 7 could be replaced by fastening means of the type utilized on the opposite side of the container.

It is to be understood that while certain forms of the present invention have been illustrated and described herein, it is not to be limited to the specific forms or arrangement of parts described and shown.

What is claimed and desired to be secured by Letters Patent is as follows:

1. A deviled egg container for housing deviled eggs in their prepared shape which comprises:

(a) a lower plate having therein a first formed portion approximately having a shape of one-half of an egg white bisected along a major axis thereof for containing a white portion of a deviled egg;

(b) an upper plate having therein a second formed portion approximately having a shape of a deviled yolk that extends above the white portion of a deviled egg for containing a yolk mixture of a deviled egg; said second formed portion being smaller in cross-section than said first formed portion, whereby when placed in abutting and facing relationship to one another, said first and second formed portions and form an egg white abutting shoulder therebetween;

(c) plate alignment means for centering said second formed portion over said first formed portion when in use containing a deviled egg and when in a closed portion such that a deviled yolk portion of an egg is in said first formed portion, an egg white portion is in said second formed portion and the egg white abuts against and is retained in position by said shoulder; and (d) fastening means for releasably holding said upper and lower plates together when in a closed position thereof.

2. A deviled egg container according to claim 1 including:

(a) hinging means between said upper and lower plates.

3. The container according to claim 2 wherein:

(a) the structural material of the container is a transparent moldable synthetic material.

4. The container according to claim 2 wherein:

(a) said molded first and second formed portions are elliptical hemispheres generally conforming to the shape and size of deviled eggs and aligned such that the major axes thereof both overlap and are parallel when said container is in the closed portion thereof.

5. The container according to claim 4 wherein (a) the major axes of said elliptical hemispheres are at right angles to a front edge of each of respective upper and lower plates.

6. The container according to claim 1 wherein said plate alignment means comprises:

(a) said upper plate being partially planar and containing a first offset extending outward from a planar portion thereof;

(b) said lower plate being partially planar and containing a second offset extending outward therefrom; said first and second offsets extending in opposite directions when said container is in the closed position thereof; and (c) said first and second offsets nesting snugly together when said container is in the closed position thereof such as to prevent relative planar movement of said upper and lower plates but allowing raising of said upper plate relative to said lower plate.

* * * * *